US007106998B2

(12) United States Patent
Tateishi et al.

(10) Patent No.: US 7,106,998 B2
(45) Date of Patent: Sep. 12, 2006

(54) FIXING APPARATUS WITH GUIDING MEMBER FOR GUIDING RELEASER

(75) Inventors: Yoshinobu Tateishi, Nara (JP); Masaru Tsuji, Nara (JP); Kazuhiro Matsuyama, Ikoma (JP); Toshiya Mikita, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 79 days.

(21) Appl. No.: 10/434,646

(22) Filed: May 9, 2003

(65) Prior Publication Data

US 2003/0223788 A1 Dec. 4, 2003

(30) Foreign Application Priority Data

May 30, 2002 (JP) ..... 2002-158097

(51) Int. Cl.
*G03G 15/20* (2006.01)
*B05C 13/00* (2006.01)
*B05C 13/02* (2006.01)

(52) U.S. Cl. ..... 399/325; 118/60

(58) Field of Classification Search ..... 399/320, 399/324, 325; 118/60, DIG. 1
See application file for complete search history.

(56) References Cited

U.S. PATENT DOCUMENTS 5,991,562 A * 11/1999 Ito et al. ..... 399/325 X
6,091,923 A * 7/2000 Yamamuro ..... 399/324
6,195,526 B1 * 2/2001 Lee et al. ..... 399/325 X
6,266,509 B1 7/2001 Ota et al. ..... 399/325
6,463,249 B1 10/2002 Mikita ..... 399/324
2001/0022908 A1 * 9/2001 Mikita ..... 399/324

FOREIGN PATENT DOCUMENTS

JP 08-137317 5/1996
JP 2000-122454 * 4/2000
JP 2001-175108 * 6/2001

* cited by examiner

*Primary Examiner*—Sandra L. Brase

(57) ABSTRACT

A fixing apparatus of the present invention is provided with (i) a roller, to which releaser gets applied (ii) a releaser applying member for applying the releaser on the roller by touching the roller while the roller is rotating, and (iii) a releaser dripping section for dripping the releaser to be applied on the roller by the releaser applying section, the fixing apparatus further including a guiding member for receiving the releaser dripped from the releaser dripping section, and for guiding, along a surface thereof, a certain amount of a total amount of the thus received releaser to a touch position at which the releaser applying member touches the roller. With this arrangement, it is possible to provide a fixing apparatus in which reduction in the amount of the releaser to be applied on the roller is avoided so as to surely prevent the toner offset and the jamming in the convey path, even if toner and/or debris is adhered, as a result of long use of the image forming apparatus, on the touch position at which the releaser applying member for applying the releaser touches the roller to which the releaser applying member applies the releaser.

15 Claims, 11 Drawing Sheets

FIXING APPARATUS WITH GUIDING MEMBER FOR GUIDING RELEASER

FIELD OF THE INVENTION

The present invention relates to a releaser applying apparatus for applying releaser (releasing agent) onto a member (releaser-target member) to which the releaser gets applied, by causing the releaser applying member to touch the releaser-target member, especially a fixing apparatus in which releaser can be stably applied on a cylinder-like shaped releaser-target member, while the releaser-target member is rotating.

BACKGROUND OF THE INVENTION

A fixing apparatus is provided in an image forming apparatus such as a photocopying machine and a printer, in which a toner image formed on a recording sheet is fixed on a recording sheet so as to obtain an image-formed medium. Moreover, in fixing apparatuses disclosed in Japanese Publication of Unexamined Patent Application, Tokukaihei, No. 8-137317 (published on May 31, 1996), U.S. Pat. No. 6,266,509 (corresponding to Japanese Publication of Unexamined Patent Application, Tokukai, No. 2000-29344 (published on Jan. 28, 2000)), and U.S. Pat. No. 6,463,249 (corresponding to Japanese Publication of Unexamined Patent Application, Tokukai, No. 2001-265151 (published on Sep. 28, 2001)), as releaser, oil such as a silicone oil is applied onto a fixing roller and a pressing roller so as to prevent (i) offset toner due to adhesion of the toner on a surface of the fixing roller, and (ii) twining a recording sheet, in order to attain stable image formation.

Referring to FIG. 8, described below is such a fixing apparatus in which oil is applied onto the fixing roller and the pressing roller. As shown in FIG. 8, a fixing apparatus 140 is provided with a fixing roller 101 and a pressing roller 102. Around the fixing roller 101, an upper sheet removing section 111, an upper cleaning roller 109, a fixing roller temperature detector 105, and an oil applying roller 107. Around the pressing roller 102, a lower sheet removing section 112, a lower clearing roller 110, and a pressing roller temperature detector 106 are provided. Moreover, the fixing roller 101 is provided with a fixing roller heater 103, while the pressing roller 102 is provided with a pressing roller heater 104.

Next, a system for applying the oil (releaser) in the fixing apparatus is explained below, referring to FIG. 8. Under the fixing apparatus 140, an oil tank 120 is provided. The oil for application is stored in the oil tank 120 always. Further, the oil tank 120 is provided with an oil remaining amount detecting sensor (for detecting how much oil is currently stored in the oil tank 120). When the oil is not enough, the oil remaining amount detecting sensor 127 gives warning on an operation panel of a main body apparatus and the like so as to urge to refill the oil. The oil is refilled via an oil supplying inlet 134.

The oil stored in the oil tank 120 is transferred to an oil dripping section 122 through an oil tube 126 by means of an oil pump 121.

The oil dripping section 122 has a tube-like (pipe-like) shape having a plurality of holes facing upward. The oil flows out through the plurality of holes and is dripped down, so as to be supplied to an oil applying member 123, which is provided under the oil dripping section 122.

When the oil is dripped on the oil applying member 123, the oil is absorbed into the oil applying member 123, which is made of such a material as to allow the oil to be spread therethrough, for example, felt. The oil applying member 123 touches the oil applying roller 107 so as to apply the oil onto the oil applying roller 107. The oil applying roller 107 is a roller (an intervening applying roller) located between the oil applying member 123 and the fixing roller 101. Further, the oil applied on the oil applying roller 107 is evenly spread out on the oil applying roller 107 by the applying blade 124. Then, the oil applying roller 107, on which the oil is spread out evenly, applies the oil on the fixing roller 101. Next, the fixing roller 101, on which the oil is applied, applies the oil on the pressing roller 102.

Moreover, excess oil, which remains unused in the oil application, is recollected by an oil pan 125 located under the oil applying member 123. The oil recollected in the oil pan 125 is returned to the oil tank 120 via a recollecting tube 128, which is connected to the oil pan 125.

Next, referring to FIG. 9, how the oil is applied from the oil applying member 123 to the oil applying roller 107 is explained in detail. The oil dripping section 122 drips oil 133 so as to supply the oil 133 to the oil applying member 123. The oil applying member 123 made of a material such as felt absorbs the oil 133 when the oil 133 is supplied to the oil applying member 123. Then, the oil 133 evenly diffuses through the oil applying member 123. The oil applying member 123 in which the oil 133 is evenly diffused, touches the oil applying roller 107 so as to apply to the oil applying roller 107 the oil 133 in the oil applying member 123.

Moreover, as shown in FIG. 9, the oil 133 is dripped on a supporting member 131 so that the oil 133 is dripped on a position (drip position) at a level higher or equal to a position (touch position) at which the oil applying member 123 touches the oil applying roller 107, and is supplied to the oil applying member 123 so as to be supplied to the oil applying roller 107 via the oil applying member 123. By having such a positional relationship, the oil 133 is transferred from the drip position at which the oil 133 is dripped on, to the touch position at which the oil applying member 123 touches the oil applying roller 107. As indicated by Arrow B in FIG. 9, the oil 133 flows down on a surface of the supporting member 131 from the drip position of the oil 133 to the oil applying member 123, and is absorbed into the oil applying member 123 and then passes through the oil applying member 123. Then, as indicated by Arrow B', the oil 133 moves to the touch position at which the oil applying member 123 touches the oil applying roller 107, and is exuded out of the oil applying member 123 so as to be applied on the oil applying roller 107. Note that excess oil 133', which remains unused in the oil application, is dropped down into the oil pan 125 so as to be recollected.

However, as shown in FIG. 10 in the system for applying the oil in the conventional fixing apparatus, as a result of long use of an image forming apparatus, toner and/or debris, which is adhered on the oil applying roller 107, is transferred onto the oil applying member 123 and accumulated thereon. Thus, as shown in FIG. 10, the toner and/or debris is adhered on a surface of the oil applying member 123, especially, the touch position at which the oil applying member 123 touches the oil applying roller 107. Moreover, the toner and/or debris adhered on the oil applying roller 107 comes from the fixing roller 101 and the pressing roller 102 at which the toner and/debris remains.

When the toner and/or debris is adhered on the touch position at which the oil applying member 123 touches the oil applying roller 107, the adhered toner and/or debris reduces an amount of the oil (the oil indicated by Arrow B') exuded out of the oil applying member 123. As shown in FIG. 10, when the toner and/or debris is adhered on at the touch position, the adhered toner and/or debris hinders the movement of the oil 133 indicated by Arrow B' and the exuding of the oil 133 from the oil applying member 123.

As described above, if the amount of the oil 133 to be exuded is reduced at the touch position due to the adhesion of the toner and/or debris, the dripping of the oil 133 in a constant amount simply leads to an increase in the amount of the excess oil 133', while an amount of the oil to be applied on the oil applying roller 107 is reduced. Further, the reduction in the amount of the oil to be applied on the oil applying roller 107 decreases an amount of the oil to be applied on the fixing roller 101 and the pressing roller 102. This causes toner offset to the fixing roller 102, and jamming of a recording sheet, for example, due to twining of the recording sheet into the fixing roller 102 and the like.

SUMMARY OF THE INVENTION

The present invention has an object to provide a fixing apparatus in which reduction in an amount of releaser such as oil to be applied on a roller is avoided even if, as a result of long use of an image forming apparatus, toner and/or debris is adhered on a touch position at which a releaser applying member for applying the releaser on a roller touches the roller on which the releaser applying member applies the releaser, whereby toner offset and jamming of a recording sheet in a conveying path are prevented.

In order to attain the foregoing objects, a fixing apparatus of the present invention including a fixing roller for fixing a toner image on a recording medium, is so arranged as to further include a guiding member, located so as to directly receive releaser dripped thereto, for guiding part of the releaser via a path to the fixing roller, and for guiding the rest of the releaser via at least one another path to the fixing roller.

In the above arrangement, the fixing roller fixes a toner image formed on the recording medium, thereby producing an image-formed medium.

As a result of image forming process over a long period, toner and/or debris is adhered on and accumulated on the fixing roller. In the related art, the dripped releaser is not directly received but indirectly received. Thus, in the related art, the releaser is guided to the fixing roller via a single path. Therefore, in the related art, the adhesion of the toner and/or debris on the fixing roller hinders the application of the releaser onto the fixing roller. As a result, an amount of the releaser to be applied onto the fixing roller is so reduced as to cause shortage, thereby causing toner offset on the fixing roller, and jamming in the convey path due to twining of a recording medium around the fixing roller.

Thus, the fixing apparatus of the present invention is provided with the guiding member, in order to solve such problems. The guiding member is so provided as to directly receive the releaser dripped thereto. Part of the thus directly received releaser is guided via a path (first path) to the fixing roller, and the rest of the thus directly received releaser is guided via at least one another path (second path) to the fixing roller.

With this arrangement, even if the adhesion of the toner and/or debris is adhered on the fixing roller as a result of the image forming process over a long period blocks the first path, it is possible to guide the releaser to the fixing roller via the second path. Further, even if it becomes impossible to guide the releaser via the second path, it is possible to guide the releaser to the fixing roller via the first path.

As described above, according to the fixing apparatus, in which the releaser is surely guided to the fixing roller and applied, it is possible to avoid the toner offset and jamming in the convey path before they happen. Thus, it is possible to provide the fixing apparatus having a high reliability.

For a fuller understanding of the nature and advantages of the invention, reference should be made to the ensuing detailed description taken in conjunction with the accompanying drawings.

BRIEF DESCRIPTION OF THE DRAWINGS

FIG. 10 is a cross sectional view of the conventional fixing apparatus in which the transfer of the releaser (oil) is hindered by debris and the like.

DESCRIPTION OF THE EMBODIMENTS

First Embodiment

Figure 1:
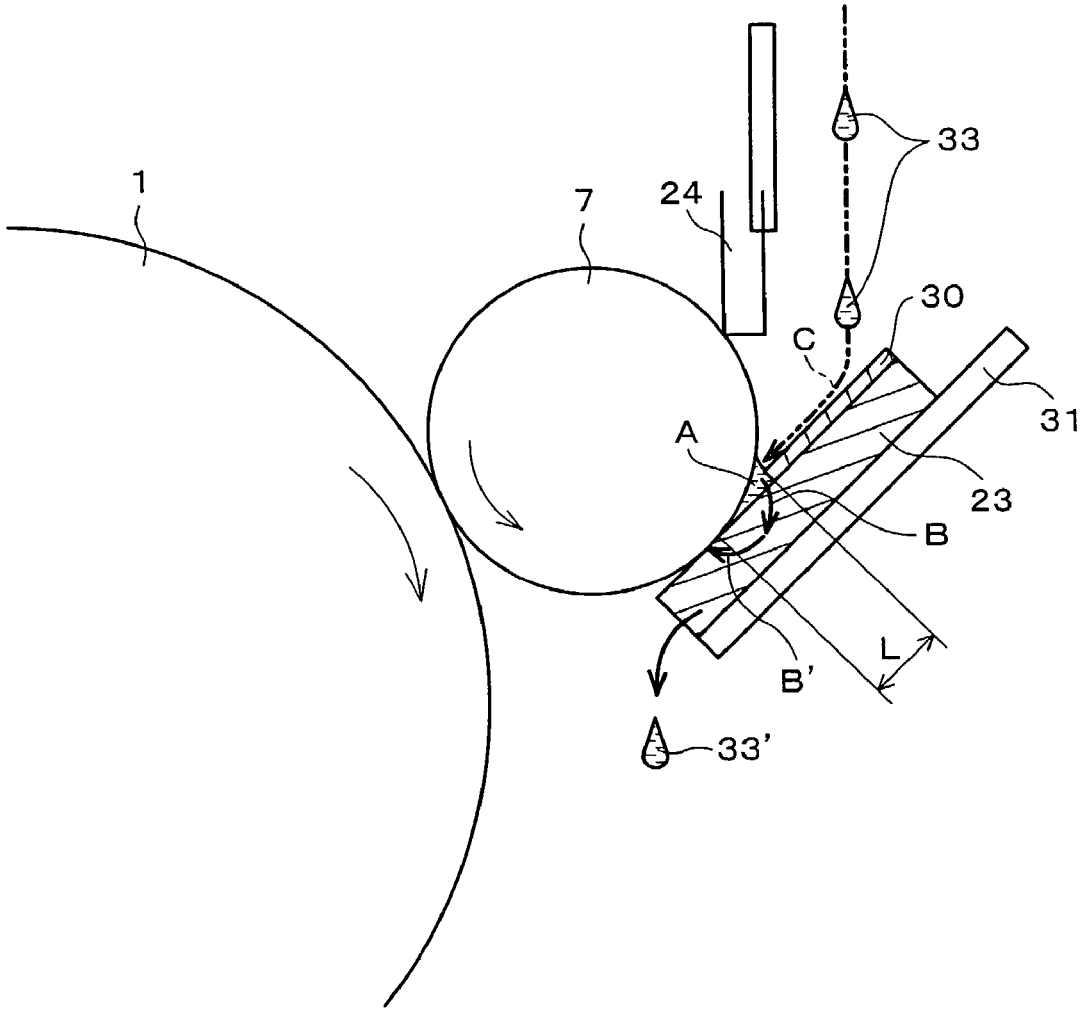
FIG. 1 is a cross sectional view illustrating how a releaser applying member and a guiding member are arranged and how releaser is transferred in a fixing apparatus in an embodiment of the present invention.
Figure 2:
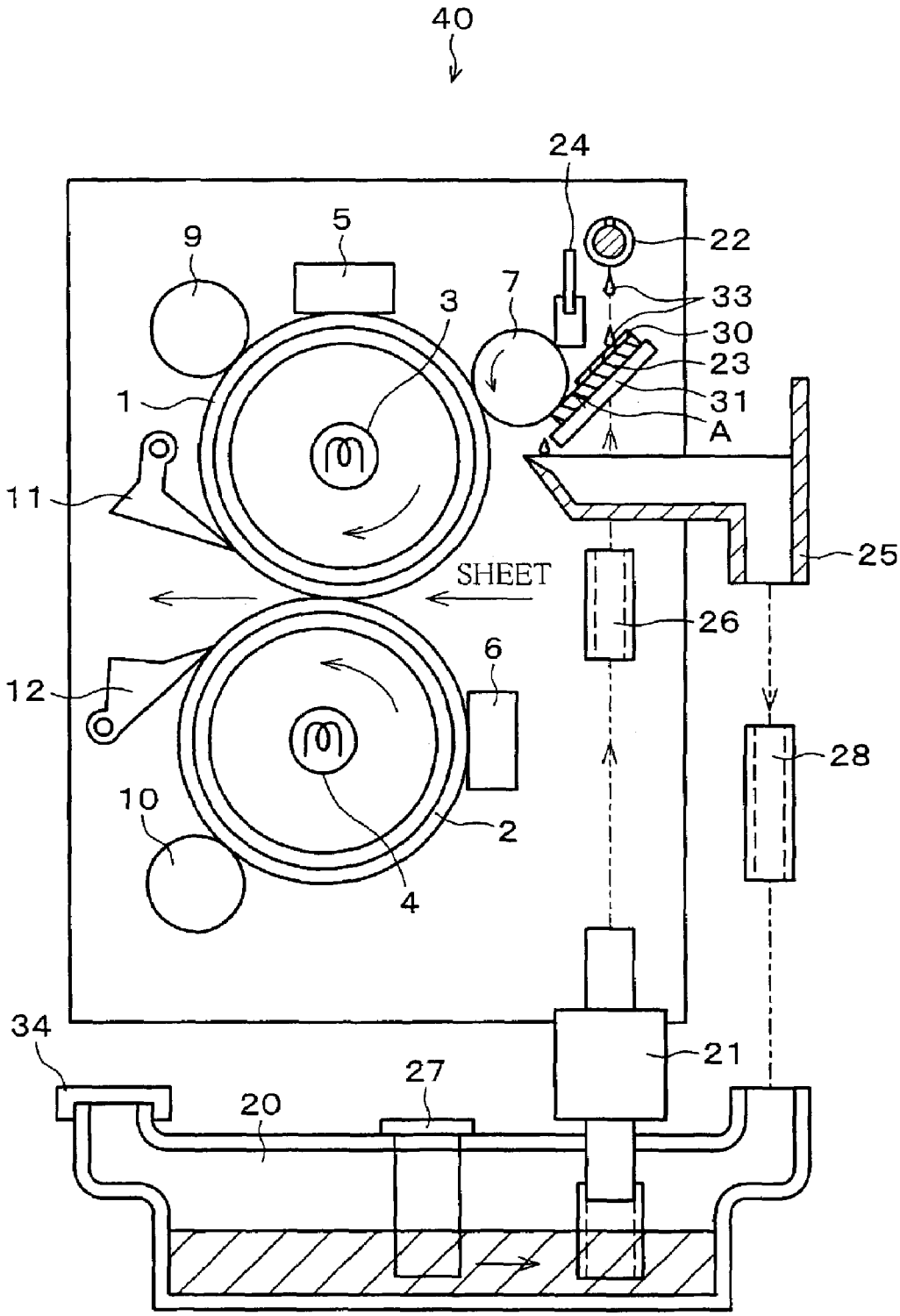
FIG. 2 is a cross sectional view of the fixing apparatus of the embodiment of the present invention.
Figure 3A:
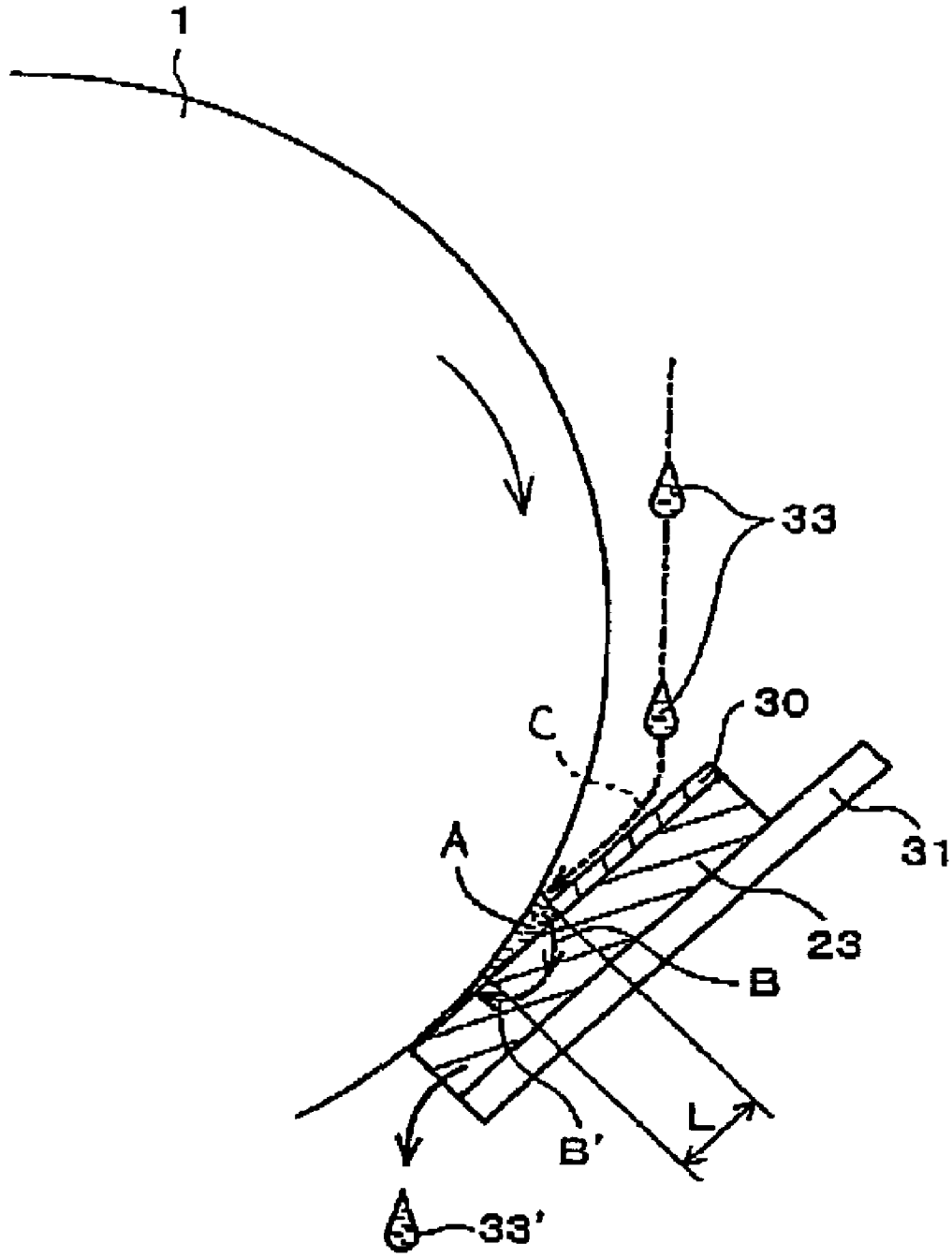
FIG. 3A is a perspective view of the fixing apparatus in another embodiment of the present invention.
Figure 3:
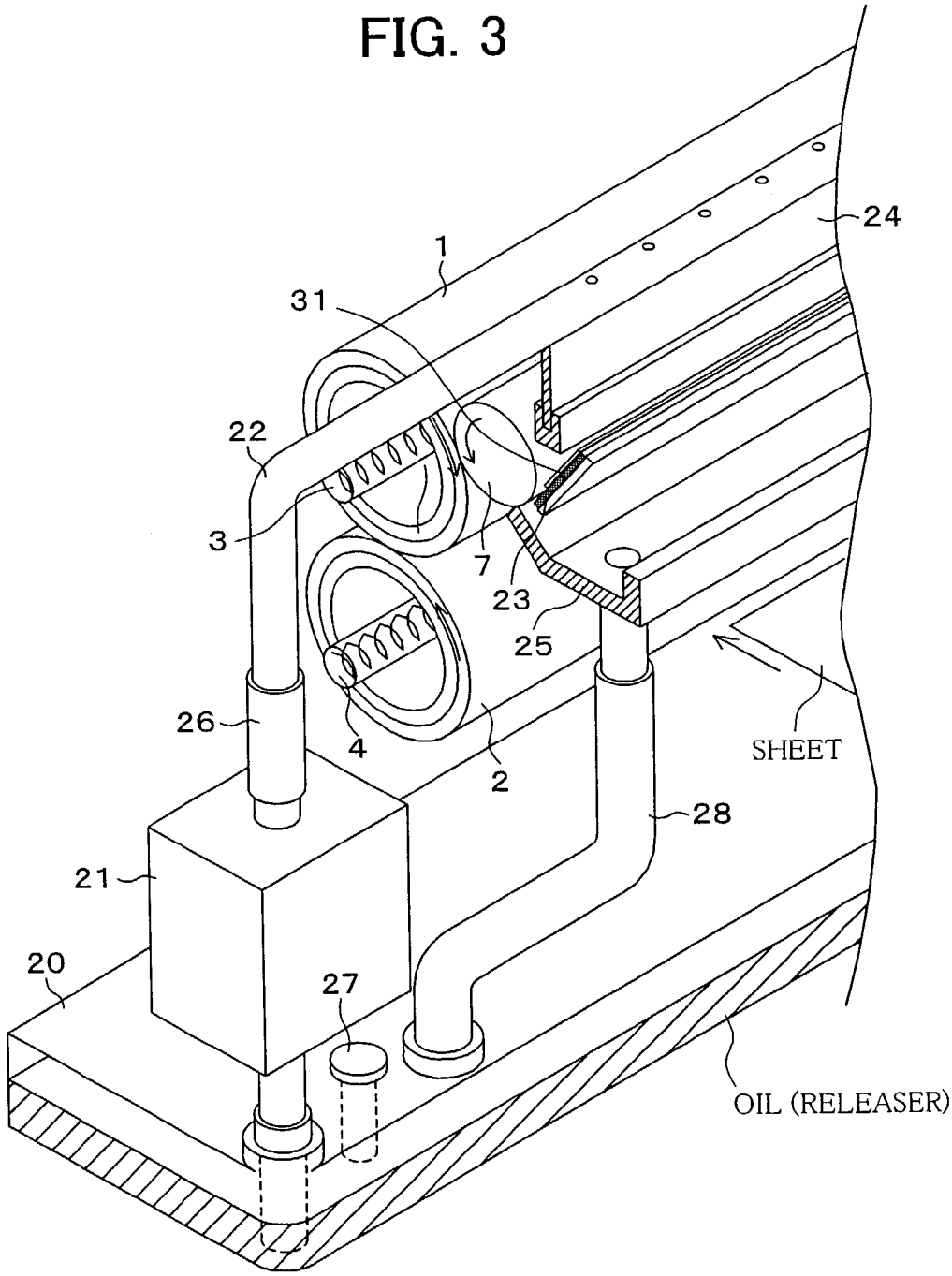
FIG. 3 is a perspective view of the fixing apparatus of the embodiment of the present invention.

The following explains an embodiment of the present invention referring to FIGS. 1 to 3. Note that in the present embodiment, releaser (oil) is firstly applied from a releaser applying member to an intervening applying roller (a releaser applying roller), which is a releaser-target member. Next, the releaser is applied on a fixing roller by the intervening applying roller.

However, the present invention is not limited to the above arrangement. For example, it is possible to omit the intervening applying roller in the above arrangement so that the releaser applying member is touched with the fixing roller rotating as shown in FIG. 3A. In such arrangement in which the intervening applying roller is omitted and the releaser applying member touches the fixing roller, the releaser applying member applies the releaser on the fixing roller.

Fixing Apparatus

To begin with, a fixing apparatus 40 of the present embodiment is explained with reference to FIG. 2. As shown in FIG. 2, the fixing apparatus 40 is provided with a fixing roller 1 and a pressing roller 2. The fixing roller 1 and the pressing roller 2 are so positioned that the fixing roller 1 and the pressing roller 2 touch and press each other. Moreover, a sheet passes through between the fixing roller 1 and the pressing roller 2, so as to fix, on the sheet, a toner image that is formed on the sheet. Moreover, the fixing roller 1 and the pressing roller 2 are respectively provided with a core bar, which is, for example, made of metal such as aluminum. Further, the fixing roller 1 and the pressing roller 2 are provided with a lubber layer around the core bar. The lubber layer is, for example, made of lubber such as silicone lubber.

Moreover, as shown in FIG. 2, the fixing roller 1 is provided with a fixing roller heater 3, while the pressing roller 2 is provided with a pressing roller heater 4. The fixing roller heater 3 is provided inside the core bar of the fixing roller 1. Further, the pressing roller heater 4 is provided in the core bar of the pressing roller 2. As the fixing roller heater 3 and the pressing roller heater 4, it is possible to use a halogen lamp or the like. Note that it is possible to arrange such that one of the fixing roller 1 and the pressing roller 2 is provided with a heater, even though in the present embodiment each of the fixing roller 1 and the pressing roller 2 is provided with the heater.

Around the fixing roller 1, as shown in FIG. 2, an upper sheet removing section 11, an upper cleaning roller 9, a fixing roller temperature detector 5, and a releaser applying roller 7 are provided. The upper sheet removing section 11 is used to remove, from a surface of the fixing roller 1, a recording sheet rolled around the fixing roller 1. The upper clearing roller 9 is a roller whose surface is made of felt. Moreover, the upper clearing roller 9 touches the surface of the fixing roller 1 so as to collect offset toner adhered on the surface of the fixing roller 1. The fixing roller temperature detector 5, which is constituted of a thermistor, detects temperature of the surface of the fixing roller 1, which touches the fixing roller temperature detector 5. A result of the temperature detection conducted by the fixing roller temperature detector 5 is sent to a fixing controller (not shown). The releaser applying roller 7 applies the releaser (oil) on the surface of the fixing roller 1, where the releaser applying roller 7 touches. For example, it is preferable that the surface of the releaser applying roller 7 is made of a material such as rubber.

Around the pressing roller 2, as shown in FIG. 2, a lower removing section 12, a lower cleaning roller 10, and a pressing roller temperature detector 6 are provided. The lower removing section 12 is used to remove, from a surface of the pressing roller 2, a recording sheet rolled around the pressing roller 2. The lower cleaning roller 10 is a roller whose surface is made of felt. Moreover, the lower cleaning roller 10 touches the surface of the pressing roller 2 so as to collect offset toner adhered on the surface of the pressing roller 2. The pressing roller temperature detector 6, which is constituted of a thermistor, detects temperature of the surface of the pressing roller 2 where the pressing roller temperature detector 6 touches. Moreover, a result of the temperature detection conducted by the pressing roller temperature detector 6 is sent to the fixing controller (not shown).

The fixing controller controls operation of a power source unit (not shown) in accordance with the result of the temperatures detection by the fixing roller temperature detector 5 and the pressing roller temperature detector 6. Further, the fixing controller controls the fixing roller heater 3 and the pressing roller heater 4 by controlling the operation of the power source unit. In short, the fixing controller adjusts temperatures of the fixing roller 1 and pressing roller 2.

Releaser Applying Apparatus of Fixing Apparatus

Next, referring to FIGS. 2 and 3, a releaser applying apparatus provided in the fixing apparatus 40 is described below. The releaser applying apparatus is an apparatus for supplying the releaser on the fixing roller 1 and the pressing roller 2. The releaser applying apparatus is provided with a releaser tank 20, a releaser pump 21, a releaser dripping section 22, a releaser applying member 23, a guiding member 30, and a supporting member 31, a releaser tray 25, a releaser tube 26, and a releaser recollecting tube 28. The releaser tank 20 is provided with a releaser supplying inlet 34 and a releaser remaining amount detecting sensor 27 (which is for detecting how much releaser is currently stored in the releaser tank 20).

In the releaser tank 20, the releaser is stored always. The releaser remaining amount detecting sensor 27 detects how much the releaser remains in the releaser tank 20. When the releaser is not enough in the releaser tank 20, the releaser remaining amount detecting sensor 27 gives warning on an operation panel of an image forming apparatus, and the like. Moreover, when the releaser remaining amount detecting sensor 27 detects that the releaser is not enough, it may be so arranged that usage of the image forming apparatus is limited. Moreover, the refill of the releaser into the releaser tank 20 is carried out by pouring the releaser via the releaser supplying inlet 34.

As the releaser pump 21, for example, a piezo-type pump, an electromagnetic pump and the like can be used. Moreover, as the releaser tube 26, for example, a member having a tube-like shape can be used.

Moreover, in the fixing apparatus 40 of the present embodiment, oil such as silicone oil, a liquid having a releasing function, a material in a liquid form having a releasing function and the like can be used as the releaser. Examples of the silicone oil usable as the releaser include, for example, dimethyl silicone oil, and denatured silicone oil such as reactive silicone oil and non-reactive silicone oil. Note that in the present embodiment silicone oil (dimethyl silicone oil having a viscosity in a range of from 100 CS to 300 CS) is used as the releaser. This is because excessively high viscosity of the releaser makes it difficult for the releaser pump 21 to pump up the releaser.

Note that the unit of viscosity "CS" is cSt (centimeter stroke). That is, the "CS" is a degree of kinetic viscosity. In SI unit, cst=0.000001 $m^2/s$.

The releaser stored in the releaser tank 20 is transferred to the releaser dripping section 22 via the releaser tube 26 by the releaser pump 21 provided above the releaser tank 20 in FIG. 2.

Top of releaser dripping section 22 has a plurality of holes facing upward as shown in FIG. 3. The releaser flows out through the plurality of holes and releaser 33 is dripped down. Moreover, under the releaser dripping section 22, a guiding member 30 is provided. Thus, releaser 33 is dripped down to the guiding member 30.

The releaser dripping section 22 has a tube-like (pipe-like) structure. Pipes made of metal such as aluminum, iron, and brass can be used as the releaser dripping section 22, for example. Moreover, a downstream end of the tube-like member is processed so that the releaser will not leak out of the downstream end of the tube-like member. For example, the downstream end is caulked by press working so as to be closed. This gives the releaser dripping section 22 a structure that allows the releaser to flow out only through the plurality of holes. Note that it is so arranged in the present embodiment that the releaser dripping section 22 has a diameter in a range of from about 5 mm to 10 mm, because it is so arranged that the releaser pump 21 has a pumping capacity to let about 3 g to 30 g of the releaser flow out per minute.

As described above, the releaser dripping section 22 has the plurality of holes (having a diameter of about 1 mm). It is possible to adopt press working, laser processing, and the like to form the holes. The holes of the releaser dripping section 22 are usually so formed as to face upward, facing opposite to a surface on which the image forming apparatus is mounted (ground), as shown in FIGS. 2 and 3. Moreover, the holes are so formed that when the image forming apparatus is mounted horizontally the releaser flows out of all of the holes of the releaser dripping section 22.

Note that it is preferable in the releaser dripping section 22 that the same amount of the releaser is flown out of each hole. However, the amounts of the releaser to be flown out from the holes may be different among the holes in some conditions. In case the amounts of the releaser to be flown out from the holes are largely different among the holes, the diameters of the holes of the releaser dripping section 22 are so adjusted that the same amount of the releaser is flown out of each hole. Note that when such adjustment is carried out the diameters of the holes of the releaser dripping section 22 are so adjusted that the farther holes from the pump have the greater diameter, in view of feeding pressure of the releaser. In short, where an end of the releaser dripping section 22 is referred to as an upstream end, the diameter becomes larger toward the downstream end, and smaller toward the upstream end.

The releaser 33 dripped down from the releaser dripping section 22 is dripped on the guiding member 30 as shown in FIGS. 1 and 2. The guiding member 30 guides, to a touch position, the releaser that is not absorbed into the guiding member 30 and moves along a surface of the guiding member 30. At the touch position, the releaser applying roller (intervening applying roller) 7 touches the releaser applying member 23. In other words, the guiding member 30 accepts (receives) the releaser 33 and causes a predetermined amount out of a total amount of the releaser 33 to move (flow) along the surface of the guiding member 30 to the touch position at which the releaser applying member 23 touches the releaser applying roller 7. Note that the releaser absorbed into the guiding member 30 and part of the releaser guided to the touch position (indicated by Arrow B in FIG. 1) move into the releaser applying section 23.

The releaser that moves to the releaser applying member 23 is absorbed into the releaser applying member 23, which is made of such a material as to allow the releaser to be evenly diffused in the surface of and inside of the releaser applying member 23. For example, the releaser applying member 23 is made of felt, or the like. Examples of the felt usable as the material of the releaser applying member 23 include felt that is made of polypropylene (hereinafter, polypropylene is abbreviated as "PP", where it is appropriate) and has a density of about 0.9 ($g/cm^3$).

Moreover, the releaser applying member 23 is supported by the supporting member 31 provided under the releaser applying member 23. The supporting member 31 is usually made of a material such as metal and resins, which do not absorb the releaser. Thus, a direction of the movement of the releaser inside of and on a lower surface of, the releaser applying member depends on the supporting member 31. Moreover, the releaser applying member 23 and the guiding member 30 shown in FIGS. 1 and 2 are tilted, so that a drip position at which the releaser 33 is dripped on the guiding member 30 is located higher than the touch position at which the releaser applying member 23 touches the releaser applying roller 7. For changing the drip position in terms of its altitude (how high or low the drip position is), and for adjusting an angle between the releaser applying member 23 and the guiding member 30, an angle of the supporting member 31 is adjusted.

The releaser applying member 23 touches the releaser applying roller 7 so as to apply the releaser on the releaser applying roller 7. The releaser applying roller 7 is a roller (intervening applying roller) positioned between the releaser applying member 23 and the fixing roller 1. If the releaser applying member 23 is made of felt, the releaser is allowed to diffuse evenly in surface of and inside of the releaser applying member 23, thereby alleviating uneven application of the releaser on the releaser applying roller 7. In short, the releaser applying member 23 has a function for evenly applying the releaser.

Moreover, the releaser applying roller 7 rotates in a direction indicated by an arrow in FIG. 2 (that is, rotates anticlockwise). The releaser applied on the releaser applying roller 7 is more evenly spread on the releaser applying roller 7 by the applying blade 24, before the releaser is applied on the fixing roller 1. Note that part of the applying blade 24 that touches the releaser applying roller 7 may be made of a material such as rubber.

Next, the releaser applying roller 7 on which the releaser is evenly applied applies the releaser on the fixing roller 1. Because the above step has spread the releaser evenly on the releaser applying roller 7, it is possible to apply a constant amount of the releaser on the fixing roller 1 evenly and thinly (that is, to be like a thin film of releaser).

The releaser should be applied evenly and thinly on the fixing roller 1 because it is important that the releaser is applied on the fixing roller 1 with a quantitative balance in a longitudinal direction of the fixing roller 1 (that is, to attain even application of the releaser in the longitudinal direction of the fixing roller 1). For example, shortage of the releaser in a certain part of the fixing roller 1 in a longitudinal direction causes problems such as twining of a sheet, and offset of an image. Moreover, excess application of oil only in a certain part of the fixing roller 1 in a longitudinal direction may cause oil leakage from the fixing apparatus. Note that, in the present embodiment, it is so arranged that the releaser dripping section 22 has seven to nine holes when the releaser dripping section 22 has a length of about 30 cm, considering a balance in the amount of the releaser to be applied in the longitudinal direction of the fixing roller 1.

Moreover, part of the releaser supplied to the guiding member 30 and the releaser applying member 23 is left unused in the application to the releaser applying roller 7. The unused (excess) releaser is recollected by means of the releaser tray 25 provided under the releaser applying member 23. Then, the releaser recollected in the releaser tray 25 is returned to the releaser tank 20 via the releaser recollecting tube 28, which is connected to the releaser tray 25.

Function of Guiding Member

Referring to FIGS. 1 and 2, described below is how the guiding member 30 works during a period between the dripping of the releaser dripped from the releaser dripping section 22 and application of the releaser onto the releaser applying roller 7. The releaser dripping section 22, as shown in FIG. 2, drips the releaser 33 therefrom. The releaser 33 is, as shown in FIG. 1, accepted (received) by the guiding member 30.

In FIG. 1, the supporting member 31, the releaser applying member 23, and the guiding member 30 are illustrated.

The releaser applying member 23 has a flat bottom surface. The bottom surface is in contact with the supporting member 31, which is flat. Further, the supporting member 31 supports the releaser applying member 23. A top surface of the releaser applying member 23 is also flat. On the top surface of the releaser applying member 23, the guiding member 30 is provided.

Moreover, as shown in FIG. 1, the guiding member 30 is so provided on the surface (top surface) of the releaser applying member 23 that the guiding member 30 will not touch the releaser applying roller 7. Moreover, the guiding member 30 receives the releaser 33 at a position (drip position) higher than the touch position at which the releaser applying member 23 touches the releaser applying roller 7. Further, the guiding member 30 is extended from the drip position of the releaser 33 to a vicinity of the touch position, whereby the releaser dripped on the guiding member 30 is allowed to move downward from the drip position. Moreover, the releaser left unused in the application and cannot be held in the releaser applying member 23 is recollected into the releaser tray 25, as releaser 33'.

Moreover, the guiding member 30 accepts the releaser dripped from the releaser dripping section 22, and causes the predetermined amount of total amount of the releaser 33 to move along the guiding member 30. For example, the guiding member 30 shown in FIG. 1 is made of a material that is, per unit volume, less absorptive for the releaser than the releaser applying member 23 is. Thus, after the releaser 33 drips on the guiding member 30, part of the releaser 33 dripped thereon will not be absorbed into the guiding member 30 but moves along the surface of the guiding member 30. Arrow C in FIG. 1 indicates a path of the movement of the releaser along the surface of the guiding member 30.

Further, the guiding member 30 receives the releaser 33, and guides to the touch position the releaser that is not absorbed and moves along the surface of the guiding member 30, as indicated by the path of Arrow C in FIG. 1.

As described above, it is possible to have two paths of the movement of the releaser in applying the releaser at the touch position, namely the path of Arrows B and B', and the path of Arrow C as shown in FIG. 1. The path of Arrows B and B' is a path for the releaser to be exuded out of the releaser applying member 23 as in the related art. Meanwhile, the path of Arrow C is a path for the releaser that moves via the guiding member 30 and especially along the surface of the guiding member 30.

There is a possibility that, between the paths, the path of Arrows B and B', that is, the path for the releaser to be exuded out of the releaser applying member 23 is blocked by toner and/or debris adhered on the touch position as a result of long use of the image forming apparatus. However, in the fixing apparatus of the present embodiment the application of the releaser can be carried out by using the releaser that moves in the path of Arrow C even if the path of Arrows B and B' is blocked by the toner and debris. Thus, it is possible to avoid reduction in an amount of the releaser to be applied on the releaser applying roller 7. Further, by avoiding the reduction in the amount of the releaser to be applied on the releaser applying roller 7, it is possible to provide a fixing apparatus in which the toner offset and jamming in a conveying path are prevented.

Moreover, as shown in FIG. 1, the guiding member 30 is located so as to be associated with that side of the releaser applying member, which the releaser applying roller 7 (to which the releaser gets applied; releaser-target member) touches. With this arrangement, it is possible to stably supply the releaser from the guiding member 30 to a top surface of the releaser applying member 23 (the top surface facing the releaser-target member).

Note that, as shown in FIG. 1, where the guiding member 30 is so provided on the surface (top surface) of the releaser applying member 23 that the guiding member 30 will not touch the releaser applying roller 7, it is preferable that the guiding member 30 is made of a material that does not absorb the releaser, for example, of metal, resins, or the like. As the resin for the guiding member 30, for example PET (polyethylene terephthalate) and the like can be used.

By having, as described above, such guiding member 30 of FIG. 1 made of a material that does not absorb the releaser (in other words, that is not absorptive for the releaser), it is possible to have a sufficient amount of the releaser that moves along the surface of the guiding member 30 in the path of Arrow C of FIG. 1.

The reference character A indicates a point in which the releaser stays. Length L of the Point A in which the releaser stays is set between about 2 mm and 3 mm. However, the length L may be set differently according to the material of the guiding member 30. Moreover, by adjusting the length L, it is possible to change a quantitative ratio between the releaser moving in the path of Arrows B and B' and the releaser moving in the path of Arrow C. Moreover, the length L is a distance between (i) the touch position at which the releaser applying member 23 touches the releaser applying roller 7 and (ii) an end of the guiding member 30. Thus, by changing location of the guiding member 30, it is possible to adjust the length L.

Moreover, for causing the releaser evenly to be diffused inside of and on the surface of the guiding member 30 so as to avoid uneven application of the releaser, it is preferable to have a certain distance between (i) the drip position at which the releaser 33 drips on the guiding member 30 and (ii) the touch position at which the releaser applying member 23 touches the releaser applying roller 7. In the present embodiment, the distance between (i) the drip position at which the releaser 33 drips on the guiding member 30 and (ii) the touch position at which the releaser applying member 23 touches the releaser applying roller 7 is set to be about 15 mm when measured on the surface of the guiding member 30.

Moreover, in FIG. 1, the movement of the releaser on the guiding member 30 is ended at Point A, which is located in front of the head of Arrow C, and in which the releaser stays. Furthermore, the movement of the releaser in the releaser applying member 23 starts from the tail of Arrow B, that is, Point A. In short, the guiding member 30 is so provided that where the movement of the releaser on the guiding member and where the movement of the releaser in the releaser applying member 23 are in contact with each other.

Second Embodiment

Described below is another embodiment of the present invention, referring to FIGS. 4 to 6. Note that members having the same functions as those in figures for the first embodiment are labeled in the same fashion and their explanation is omitted here.

Figure 4:
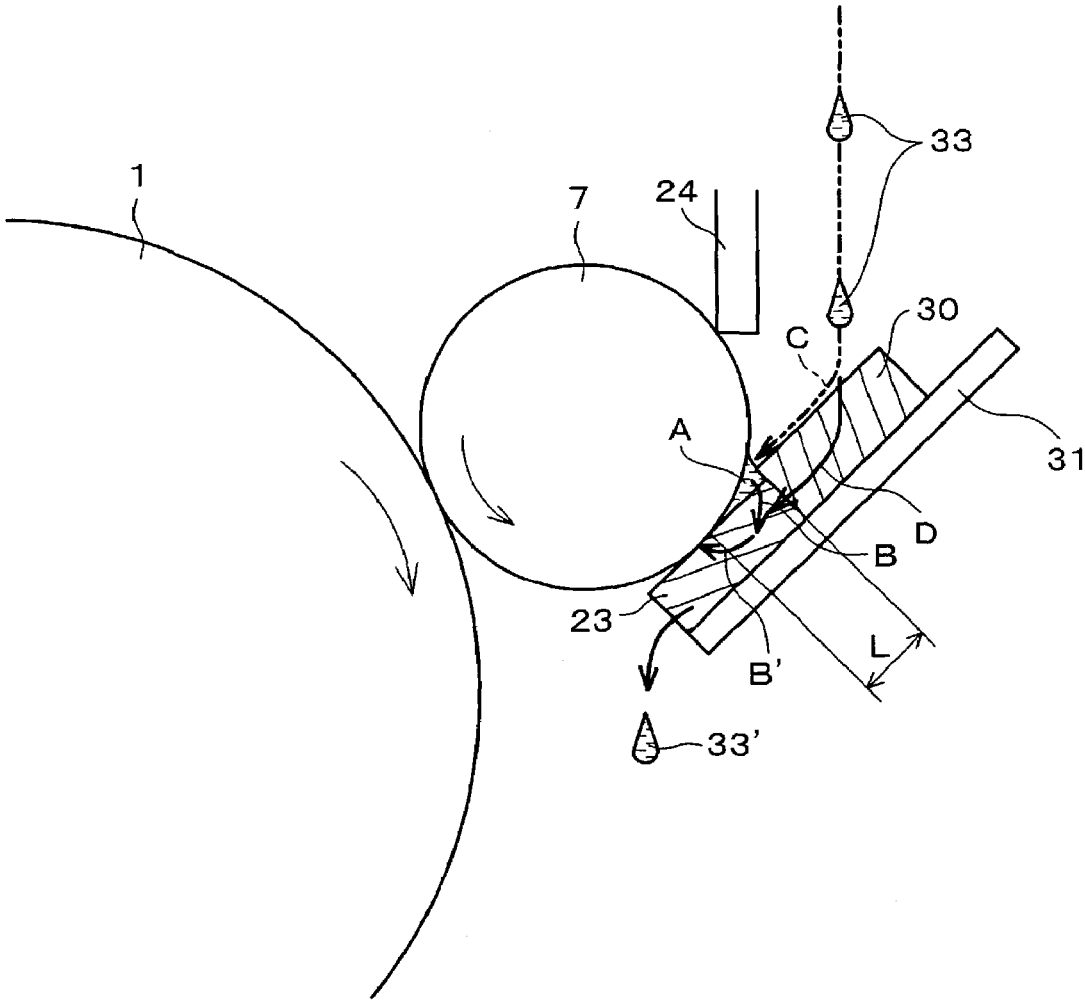
FIG. 4 is a cross sectional view illustrating how a releaser applying member and a guiding member are arranged and how releaser is transferred in a fixing apparatus in another embodiment of the present invention.

Referring to FIG. 4, explained below is a guiding member 30, which has a different position from the corresponding one in the first embodiment. In the first embodiment, the guiding member 30 is provided on the surface of the releaser applying member 23. However, in the present embodiment, the guiding member 30 is provided on a supporting member 31, and at a position higher than a releaser applying member 23. As shown in FIG. 4, the guiding member 30 and the releaser applying member 23 are provided on the surface (top surface) of the supporting member 31 that is flat.

Moreover, sides of the guiding member 30 and the releaser applying member 23 are provided perpendicularly to the surface of the supporting member 31. Further, the lower side of the guiding member 30 is in contact with the higher side of the releaser applying member 23.

The guiding member 30 shown in FIG. 4 is made of such a material that is, per unit volume, less absorptive for the releaser than the releaser applying member 23 is. Specifically speaking, the releaser applying member 23 was made of felt whose material is PP (polypropylene) and which had a density of about 0.9 ($g/cm^3$). Moreover, the guiding member 30 was made of felt whose material is nylon (Registered Trademark) and which had a density of about 1.14 ($g/cm^3$).

Moreover, in the present embodiment, the guiding member 30 may be so arranged as to have the same material as the releaser applying member 23 and to have a density larger than that of the releaser applying member 23. For example, it may be so arranged that the releaser applying member 23 is made of felt whose material is PP and which has a density of about 0.9 ($g/cm^3$), while the guiding member 30 is made of felt whose material is PP and which has a density greater than 0.9 ($g/cm^3$).

By having the guiding member 30 having such arrangement, two paths are obtained for the releaser, namely, a path to move following Arrow D or B, and then Arrow B' (path of Arrow D or B and Arrow B'), and a path to move following Arrow C (path of Arrow C), as shown in FIG. 4. In short, the guiding member 30, which has a density greater than that of the releaser applying member, guides the releaser moving along the surface thereof (the releaser moving in the path of Arrow C) to a touch position at which the releaser applying member 23 touches a releaser applying roller 7 (a releaser-target member). As a result, even if toner and/or debris is adhered on the touch position and blocks the path of Arrow D or B and Arrow B' (the path for the releaser to exude out from the releaser applying member 23), it is possible to carry out the application by applying the releaser moving in the path of Arrow C. Thus, it is possible to avoid reduction in an amount of the releaser to be applied on the releaser applying roller 7.

Moreover, in the present embodiment, in which the guiding member 30 is made of felt or the like, it is possible to cause releaser 33, which dripped on the guiding member 30, to evenly diffuse inside of the guiding member 30 and on a surface of the guiding member 30. Further, it is possible to cause the thus diffused releaser to move to the releaser applying member 23. As a result, it is possible to apply the releaser evenly on the releaser applying roller 7, which touches the releaser applying member 23.

Moreover, in the present embodiment, in the guiding member 30, the releaser can move in the path of Arrow C and in the path of Arrow D, as shown in FIG. 4. In the path of Arrow C, the releaser moves on the surface of the guiding member 30. Meanwhile, in the path of Arrow D, the releaser moves in (inside of) the guiding member 30.

To begin with, the movement in the path of Arrow C is discussed below. In front of a head of Arrow C is Point A in which the releaser stays. Moreover, in the releaser applying member 23, the releaser starts moving at a tail of Arrow B, in other words, from Point A in which the releaser stays. Therefore, the guiding member 30 is so positioned that (i) a goal of the movement of the releaser in the guiding member 30 (the head of Arrow C) and (ii) the start of the movement of the releaser in the releaser applying member 23 (the tail of Arrow B) touch each other (the movement of the releaser in the guiding member 30 ends in an area from which movement of the releaser in the releaser applying member 23 starts).

Next, the movement in the path of Arrow D is discussed below. In case of the path of Arrow D, that is, the path in which the releaser moves from the inside of the guiding member 30 to the inside of the releaser applying member 23, the releaser that moves out of the guiding member 30 moves directly into the releaser applying member 23 because the guising member 30 and the releaser applying member 23 touch each other as shown in FIG. 4. Thus, the guiding member 30 is so positioned that the goal of the movement of the releaser in the guiding member 30 and the start of the movement of the releaser in the releaser applying member 23 touch each other (the movement of the releaser in the guiding member 30 ends in an area from which movement of the releaser in the releaser applying member 23 starts).

Moreover, as shown in FIG. 4, the guiding member 30 is so provided on the releaser applying member 23 that the guiding member 30 will not touch the releaser applying roller 7. Moreover, the guiding member 30 receives the releaser 33 at a position (drip position) higher than the touch position at which the releaser applying member 23 touches the releaser applying roller 7. However, where both the releaser applying member 23 and the guiding member 30 are made of, for example, a felt and the like material that absorbs the releaser to some extent, it is possible to apply the releaser even if the drip position of the releaser 33 is at the same level as the touch position at which the releaser applying member 23 touches the releaser applying roller 7.

Figure 5:
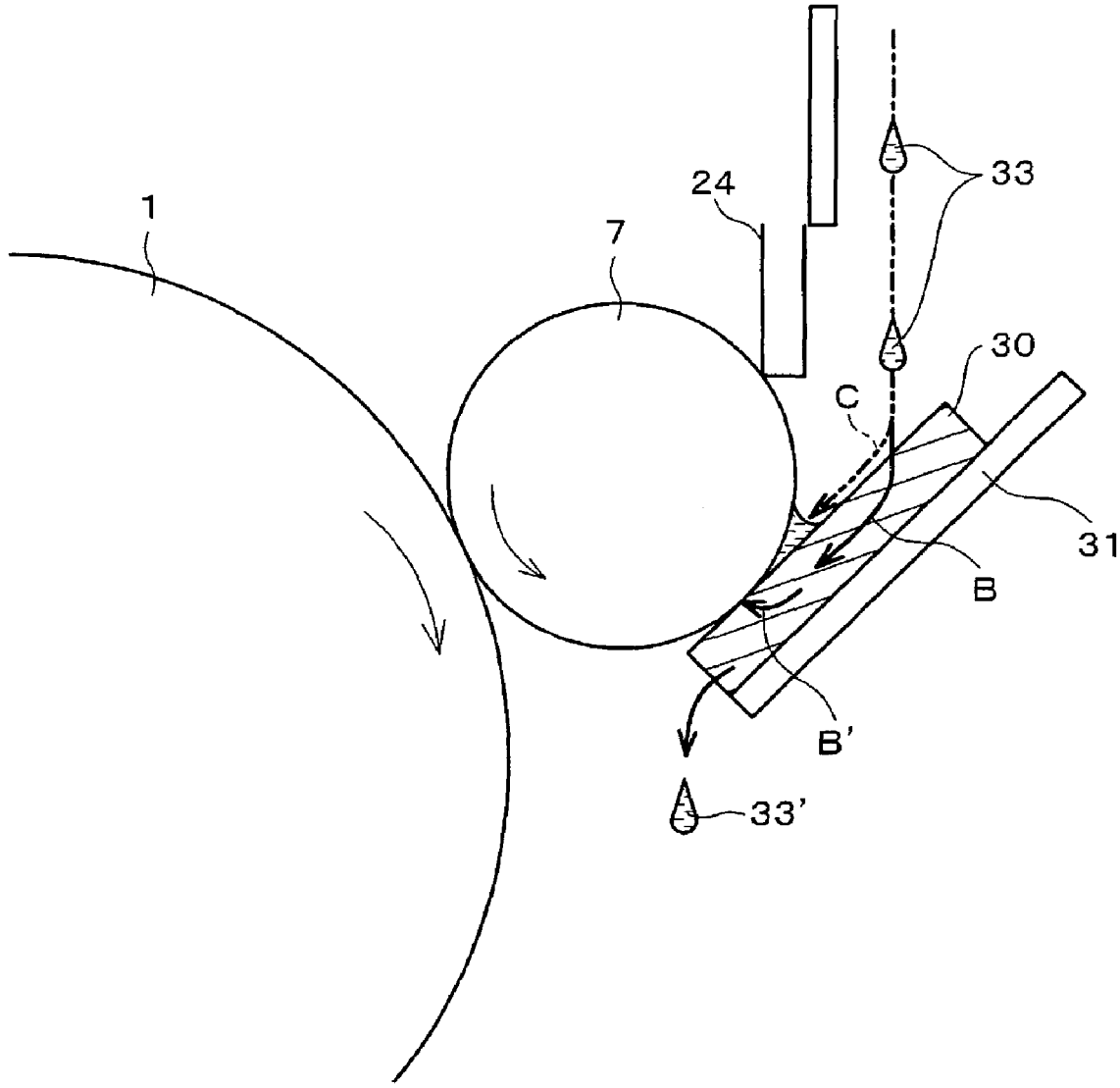
FIG. 5 is a cross sectional view illustrating yet another embodiment of the present invention in which a guiding member also serves as a releaser applying member.
Figure 6:
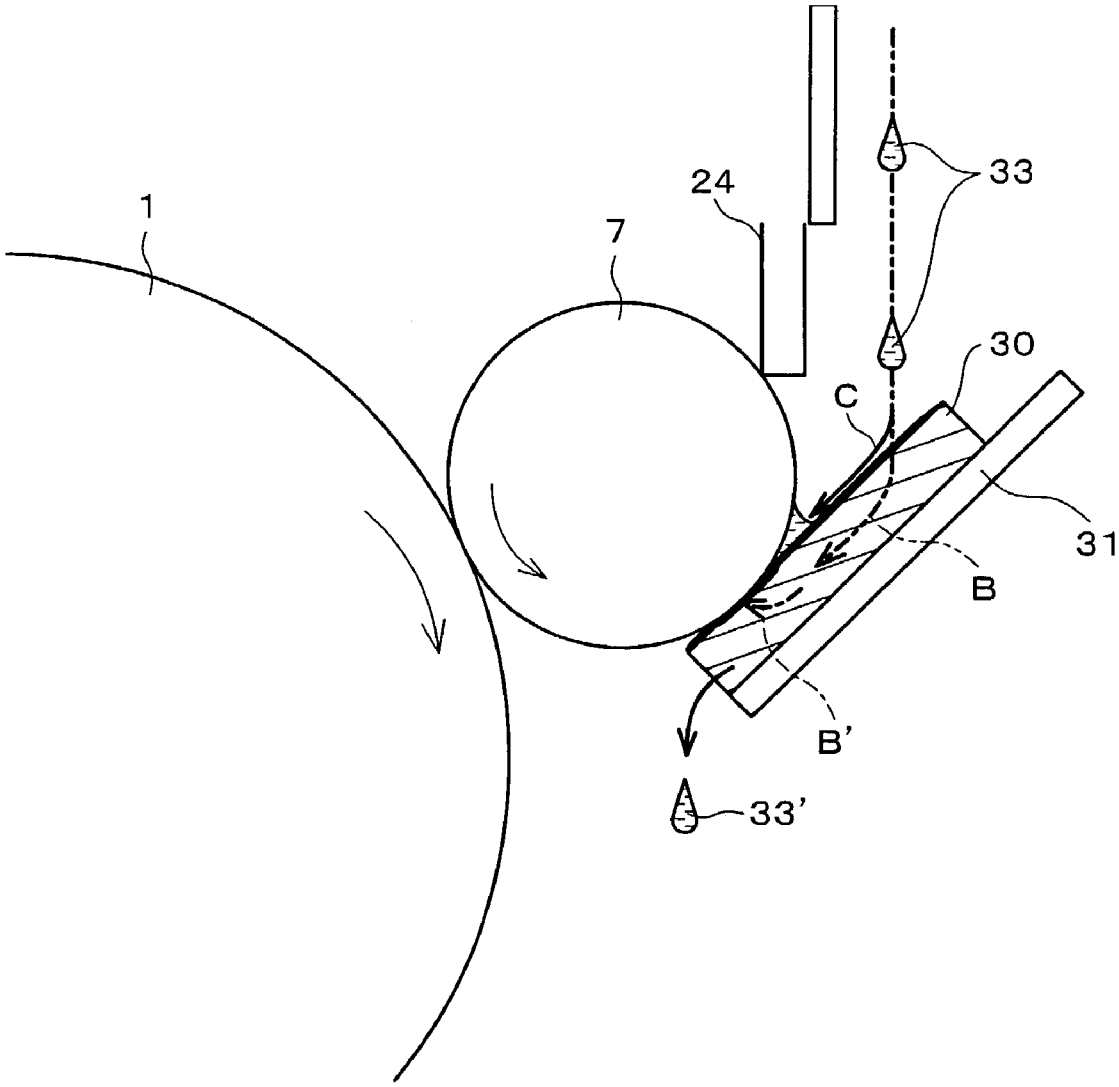
FIG. 6 is a cross sectional view illustrating how releaser is transferred when toner and/or debris is adhered on a surface of the guiding member shown in FIG. 5.

Note that the present invention may be so arranged that the releaser applying member and the guiding member 30 are integrated into one guiding member 30, as shown in FIG. 5. In other words, it may be so arranged that the guiding member 30 also functions (serves) as the releaser applying member.

Moreover, in case where the guiding member 30, which is integrated with the releaser applying member, also serves as a releaser applying member, a certain effect can be attained by simply arranging the guiding member 30 to have a longer length. Specifically, the longer length allows the releaser 33 to drip on the guiding member 30, instead of on a supporting member 31. This arrangement works as follows. Before toner and/or debris is adhered on the guiding member 30, the path in which the releaser 33 goes into the guiding member 30 and is applied on the releaser applying roller 7, that is, the path of Arrows B and B' is available, as shown in FIG. 5. Then, as a result of long use of an image forming apparatus, the toner and/or debris, which is also scattered on the guiding member 30, gradually hinders the absorption (movement of Arrow B) of the releaser into the guiding member 30, as shown in FIG. 6. Further, the hindrance in the absorption (movement of Arrow B) of the releaser into the guiding member 30 reduces an amount of the releaser that is supplied via the path of Arrow B'. However, the adhesion of the toner and/or debris on a surface of the guiding member 30 allows the releaser to move in the path of Arrow C, while hindering the releaser to move in the path of Arrow B. In short, the releaser that is hindered to move in the path of Arrow B flows on the surface (top surface) of the guiding member 30. Thus, the adhesion of the toner and/or debris on the guiding member 30 newly forms the path of Arrow C, thereby preventing insufficient supply of the releaser to the releaser applying roller 7.

Figure 9:
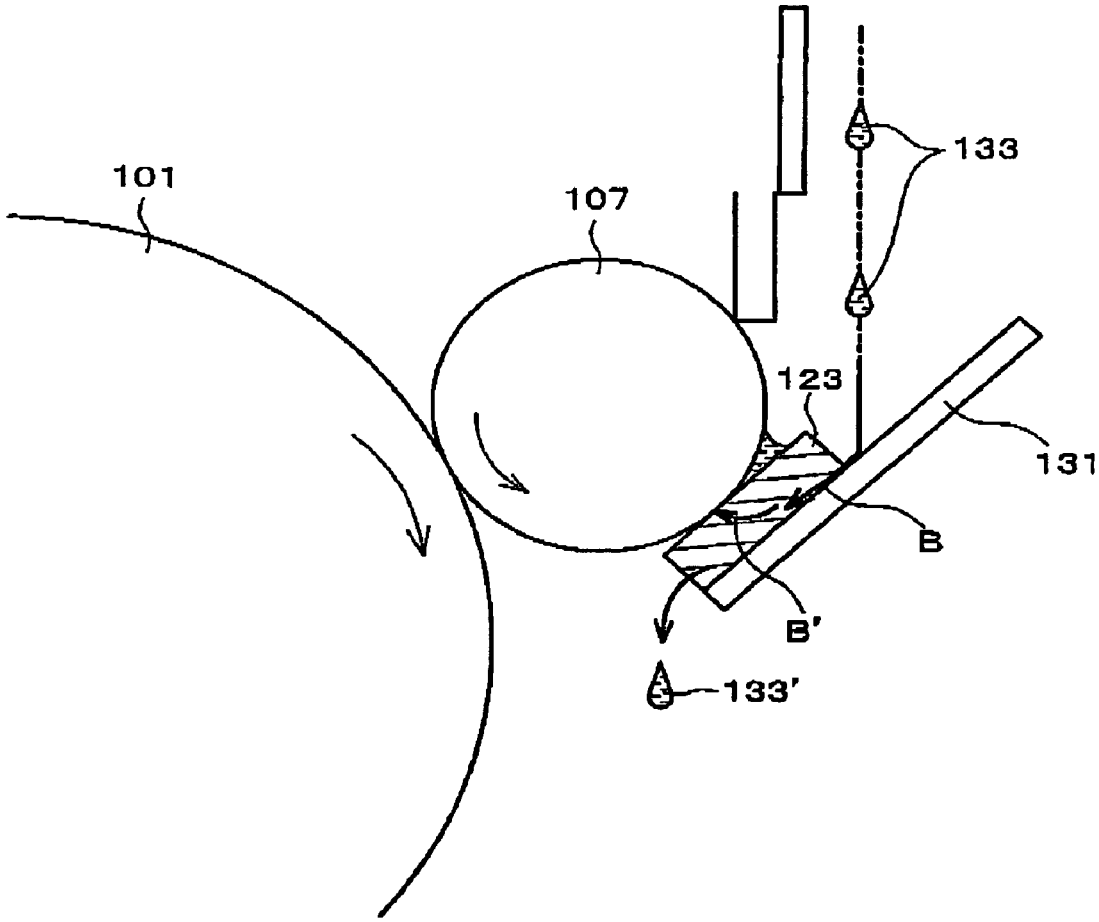
FIG. 9 PRIOR ART
FIG. 9 is a cross sectional view illustrating how a releaser applying member is arranged and how releaser is transferred in a conventional fixing apparatus.
Figure 10:
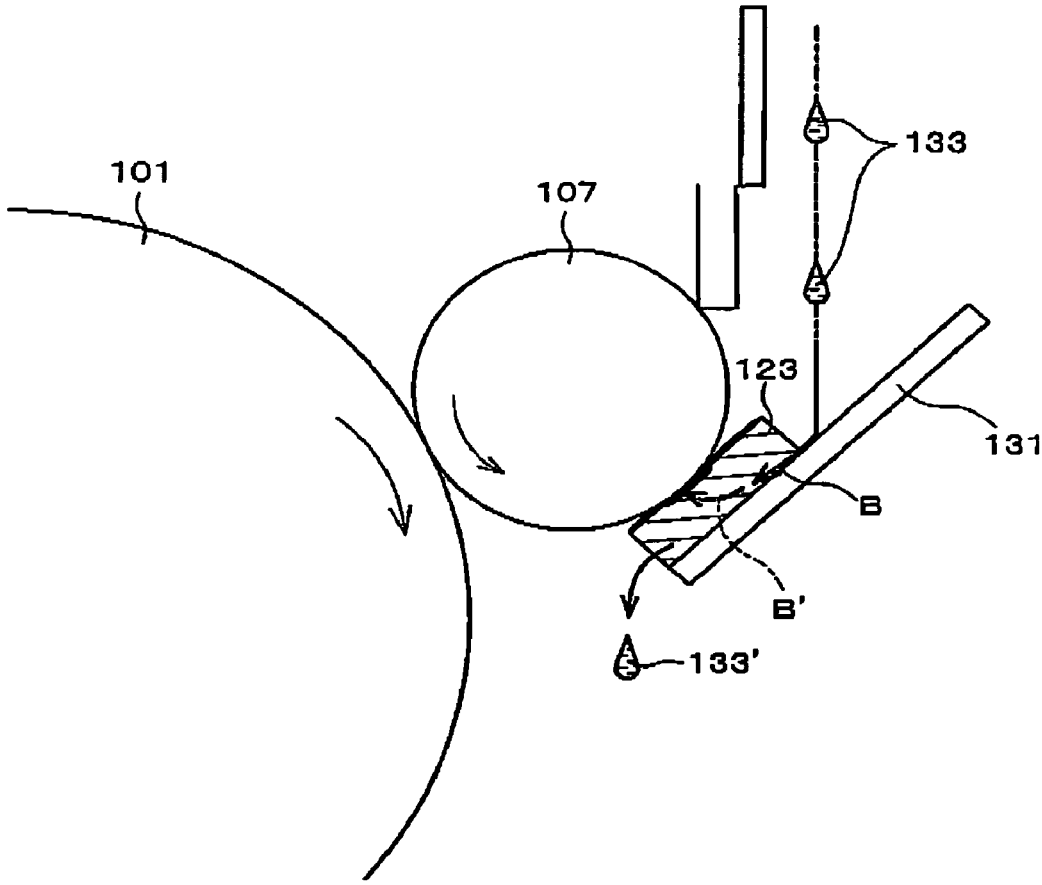
FIG. 10 PRIOR ART

Further, in case where the guiding member 30 also functions as the releaser applying member as shown in FIG. 5, it is possible to obtain the path of Arrow C for the releaser, even if the guiding member 30 is made of felt (for example made of nylon and having a density of about 1.14 (g/cm$^3$) or made of polyester and having a density of about 1.38 (g/cm$^3$)), whose material is, per unit volume, less absorptive for the releaser than the conventional releaser applying member (the oil (releaser) applying member 123 shown in FIG. 9). Therefore, it is possible to obtain an effect to avoid reduction in an amount of the releaser to be applied on the releaser applying roller 7.

Third Embodiment

A still another embodiment of the present invention will be explained below, referring to FIG. 7. Note that members having the same functions as those in figures for the first embodiment are labeled in the same fashion and their explanation is omitted here.

Figure 7:
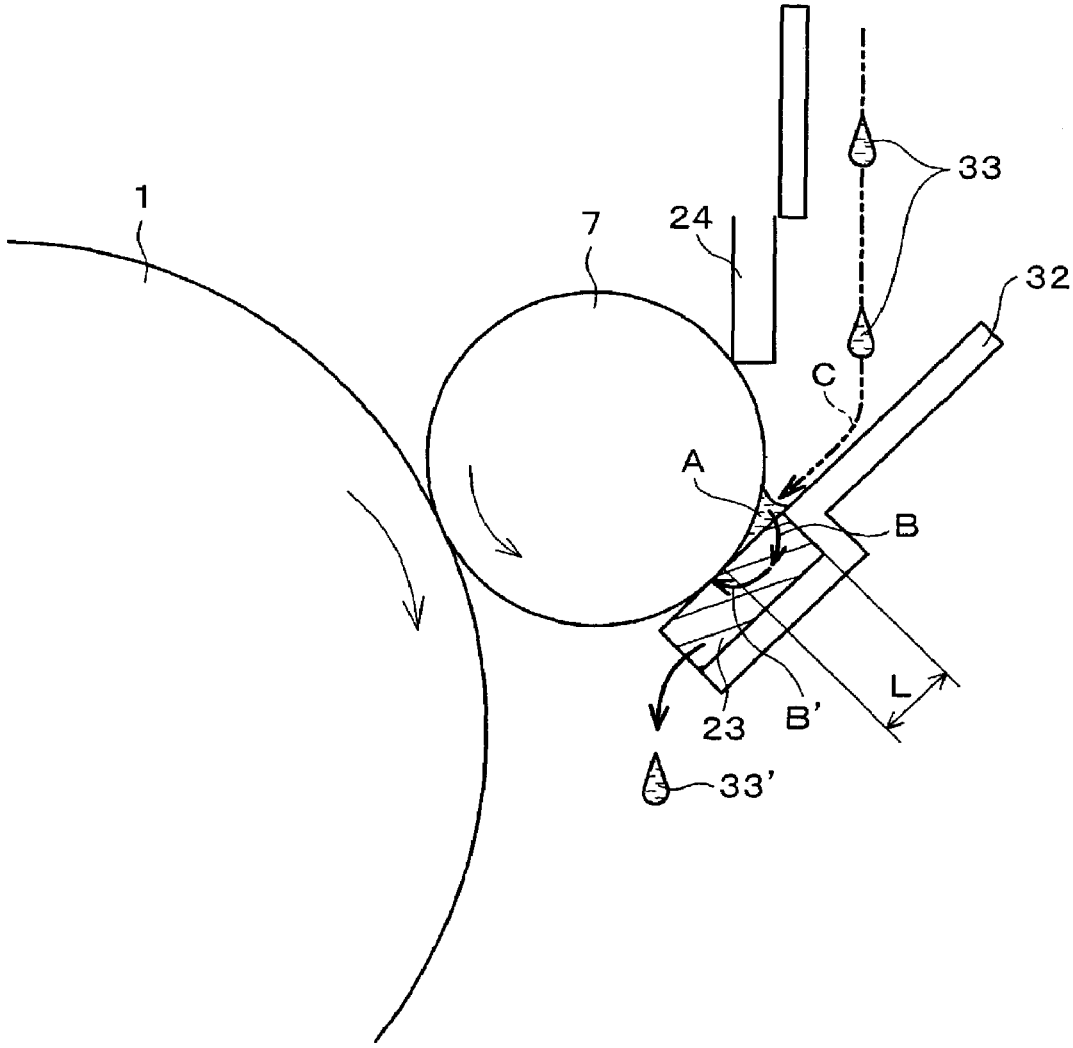
FIG. 7 is a cross sectional view illustrating how a releaser applying member and a guiding (support-guide) member are arranged and how releaser is transferred in a fixing apparatus in a still another embodiment of the present invention.
Figure 8:
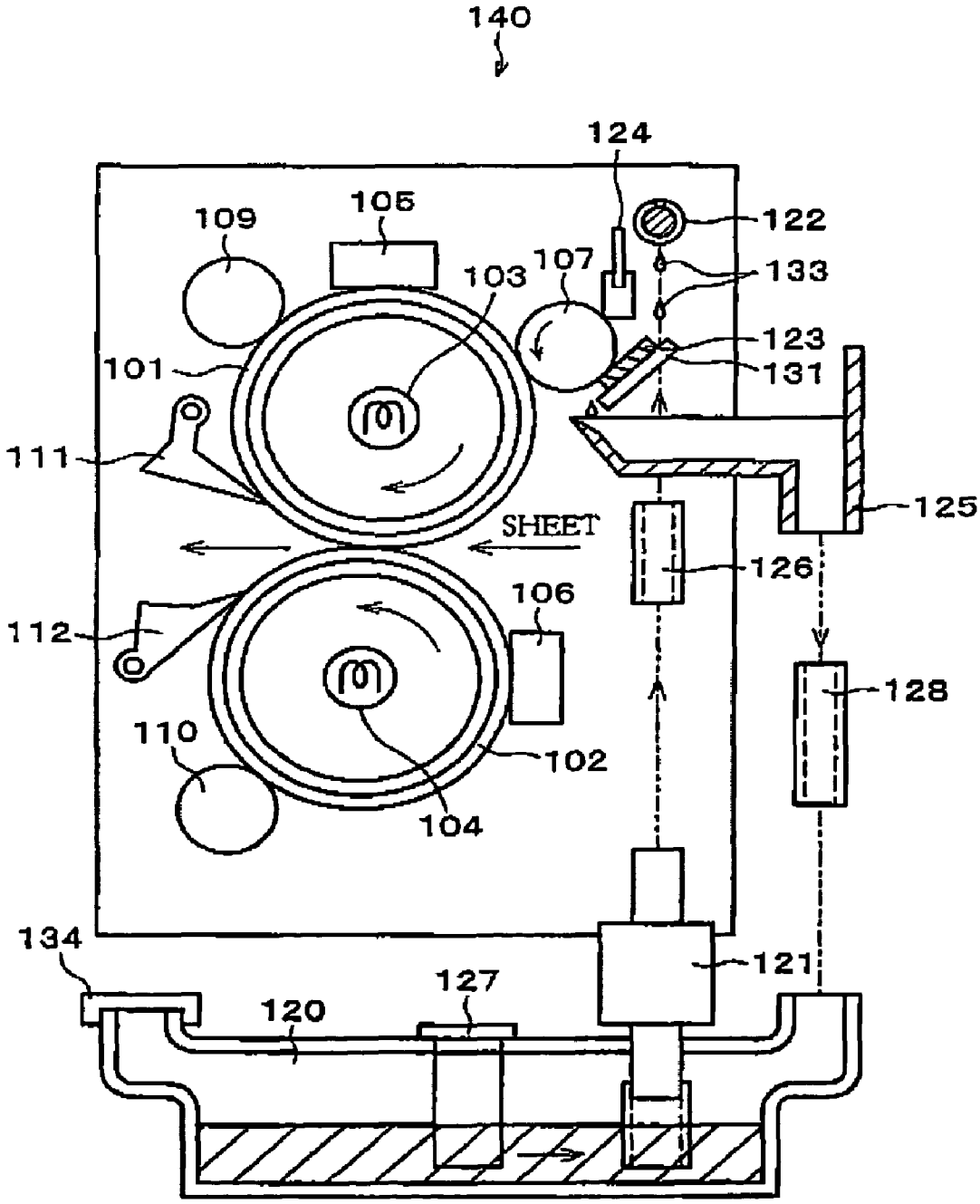
FIG. 8 PRIOR ART
FIG. 8 is a cross sectional view illustrating a conventional fixing apparatus.

In FIG. 7, part of a supporting member, which is used as a guiding member, is illustrated. A support-guide member 32, part of which is used as the guiding member, may be made of the same material (that does not absorbs releaser) as a conventional supporting member, for example. As a result, it is possible to easily provide the guiding member.

Even if the support-guide member 32 is provided as shown in FIG. 7, of course, it is possible to obtain a path of Arrows B and B' (path for the releaser exuded out of the releaser applying member 23) and a path of Arrow C (path for the releaser that moves via a guiding member 30, especially on a surface of the guiding member 30), as in the first embodiment. Thus, as in the first embodiment, even if the path of Arrow B and B' is blocked by adhered toner and/or debris, it is possible to perform the application of the releaser by using the releaser moving in the path of Arrow C. Thus, it is possible to avoid reduction in an amount of the releaser to be applied on the releaser applying roller 7.

EXAMPLES

Conducted were experiments for comparing (i) application in which only the conventional oil (releaser) applying member 123 shown in FIG. 9 was used, (ii) application in which the guiding member 30 and the releaser applying member 23 shown in FIG. 4 were used, and (iii) application in which the guiding member 30 and the releaser applying member 23 shown in FIG. 1 were used. Results of the experiments are shown in Tables 1 and 2.

Table 1 shows results of one of the experiments. In the experiment shown in Table 1, tested was approximately how many recording sheets an image forming apparatus proceed before occurrence of toner offset on a fixing roller or jamming in a convey path due to twining of a recording sheet around the fixing roller 1 or 101, and the like. Shown in Table 2 is a change in an amount of releaser to be applied (an amount of the releaser per sheet of A4 size) as the image forming apparatus was used. Note that in Tables 1 and 2, (1) was a result as to conventional application shown in FIG. 9 in which only the releaser applying member 23 was used, (2) was a result as to application as shown in FIG. 4 in which the guiding member 30 and the releaser applying member 23 were used, and (3) was a result as to application as shown in FIG. 1 in which the guiding member 30 and the releaser applying member 23 were used.

Note that in the present example the oil (releaser) applying member 123 and the releaser applying member 23 were made of felt (Fujilon 3000), which was made of PP and had a density of 0.91 (g/cm$^3$), supplied from Fuji Corp. Moreover, in these experiments, the oil (releaser) applying member 123 and the releaser applying member 23 had the same size and volume. Furthermore, the guiding member 30 shown in FIG. 1 was made of PET, while the guiding member 30 shown in FIG. 4 was made of felt (Fujilon 5000), which was made of PP and had a density of 1.38 (g/cm$^3$), supplied from Fuji Corp.

TABLE 1

| No. | ARRANGEMENT OF GUIDING MEMBER | START | 20 T. | 40 T. | 60 T. | 80 T. |
|---|---|---|---|---|---|---|
| (1) | CONVENTIONAL (FIG.9) | ○ | ○ | ○ | Δ | x |
| (2) | GUIDING MEMBER (USUAL + FINE TEXTURE) (FIG. 4) | ○ | ○ | ○ | ○ | ○ |
| (3) | GUIDING MEMBER (USUAL + RESIN SHEET) (FIG. 1) | ○ | ○ | ○ | ○ | ○ |

Abbreviation: "T." stands for thousand sheets.

In Table 1, the mark "○" indicates that the process of recording sheets was carried out normally without occurrence of toner offset to the fixing roller and the jamming of the recording sheets in the convey path due to the twining of recording sheets around the fixing roller and the like. The mark "Δ" indicates that the process of recording sheets was carried out with occasional occurrence of toner offset to the fixing roller and the jamming of the recording sheets in the convey path due to the twining of recording sheets around the fixing roller and the like. The mark "×" indicates that the process of recording sheets was carried out with frequent occurrence of toner offset to the fixing roller and the jamming of the recording sheets in the convey path due to the twining of recording sheets around the fixing roller and the like.

As shown in Table 1, in (1) the toner offset and the jamming in the convey path started to occur after approximately 60 thousand recording sheets were processed, and the toner offset and the jamming in the convey path frequently occurred after approximately 80 thousand recording sheets were processed. On the contrary, in (2) and (3), the toner offset and the jamming in the convey path did not occur even after approximately 80 thousand recording sheets were processed. In short, Table 1 shows that the use of guiding member prevented the occurrence of the toner offset and the jamming in the convey path.

TABLE 2

| No. | ARRANGEMENT OF GUIDING MEMBER | Unit (mg/sheet) 40 T. | 80 T. |
|---|---|---|---|
| (1) | CONVENTIONAL (FIG. 9) | +1 | −9 |
| (2) | GUIDING MEMBER (USUAL + FINE TEXTURE) (FIG. 4) | +2 | +1 |
| (3) | GUIDING MEMBER (USUAL + RESIN SHEET) (FIG. 1) | +1 | ±0 |

In (1), the amount of oil was significantly reduced after 80 thousand recording sheets were processed.
Meanwhile, in (2) and (3), the amount of oil was not changed much after 80 thousand recording sheets are processed.

Moreover, as shown in Table 2, in (1) the amount of oil was significantly reduced after 80 thousand recording sheets were processed. Meanwhile, in (2) and (3), the amount of oil was not changed much after 80 thousand recording sheets are processed. In short, Table 2 explains that the use of the guiding member prevented the reduction in the amount of the releaser applied on the roller even if, as the image forming apparatus was used, toner and/or debris adhered on the touch position at which the releaser applying member for applying the releaser touched the roller to which the releaser was applied from the releaser applying member.

As described above, a fixing apparatus of the present invention is provided with (i) a fixing roller, (ii) a releaser applying member for applying releaser on the fixing roller by touching the fixing roller while the fixing roller is rotating, and (iii) a releaser dripping section for dripping the releaser to be applied on the fixing roller by the releaser applying member, the fixing apparatus being further provided with a guiding member for receiving the releaser dripped from the releaser dripping section, and for guiding, along a surface thereof, a certain amount of a total amount of the thus received releaser to a touch position at which the releaser applying member touches the fixing roller.

In this foregoing arrangement, the releaser is dripped onto the guiding member from the releaser dripping section for dripping the releaser, for example, the releaser dripping section having a tube-like (pipe-like) shape having holes facing upward. Note that the releaser discussed here may be, for example, oil such as silicone oil, a liquid having a releasing function, and a material in a liquid form having a releasing function and the like.

Moreover, in the forgoing arrangement, the guiding member is so located that the guiding member will guides, the releaser, which dripped thereon from the release dripping section, along the surface thereof to the touch position at which the releaser applying member touches the fixing roller, In order to locate the guiding member so that the guiding member will guide, to the touch position the releaser moving along the surface thereof, the fixing apparatus may be so arranged that the drip position is located higher than the touch position, and the guiding member is extended from the drip position to a vicinity of the touch position. Thereby, the releaser dripped on the guiding member is allowed to move along the surface of the guiding member downward from the drip position, and is guided to the touch position. In short, unlike the related art, the application of the releaser onto the fixing roller at the touch position, is carried out not only the releaser exuded out of the releaser applying member but also the releaser moving inside of the guiding member, especially the releaser moving along the surface of the guiding member.

Moreover, in the foregoing arrangement, the guiding member guides, along a surface thereof, a certain amount of the total amount of the thus received releaser to a touch position at which the releaser applying member touches the fixing roller. Note that the "certain amount of the total amount of the thus received releaser" is, for example, an amount of the releaser necessary for preventing the toner offset and the jamming in the convey path according to this arrangement in which the releaser in that certain amount is guided and applied on the fixing roller.

As a result, it is possible to provide a fixing apparatus in which reduction in the amount of the releaser to be applied on the roller is avoided so as to surely prevent the toner offset and the jamming in the convey path, even if toner and/or debris is adhered, as a result of long use of the image forming apparatus, on the touch position at which the releaser applying member for applying the releaser such as oil touches the roller (fixing roller) to which the releaser applying member applies the releaser.

Moreover, a fixing apparatus of the present invention is provided with (i) a fixing roller, (ii) an intervening applying roller for applying releaser on the fixing roller while the fixing roller is rotating, (iii) a releaser applying member for applying the releaser on the intervening applying roller by touching the intervening applying roller while the intervening applying roller is rotating, and (iv) a releaser dripping section for dripping the releaser to be applied on the intervening applying roller by the releaser applying section, the fixing apparatus being further provided with a guiding member for receiving the releaser dripped from the releaser dripping section, and for guiding, along a surface thereof, a certain amount of a total amount of the thus received releaser to a touch position at which the releaser applying member touches the intervening applying roller.

In the foregoing arrangement, the releaser dripped on the guiding member is moved along the surface of the guiding member. Moreover, in the foregoing arrangement, the guiding member is so provided that the guiding member will receive the releaser dripped from the releaser dripping section, and guides, to the touch position at which the releaser applying member touches the intervening applying roller, the releaser that moves along the surface of the guiding member. By arranging the guiding member as such unlike the related art, the application of the releaser onto the intervening applying roller at the touch position is carried out not only by using the releaser exuded out of the releaser applying member but also by using the releaser moving inside of the guiding member, especially the releaser moving along the surface of the guiding member.

Moreover, in the foregoing arrangement, the guiding member receives the releaser dripped from the releaser dripped from the releaser dripping section, and guides, along a surface thereof, a certain amount of the total amount of the thus received releaser to a touch position at which the releaser applying member touches the intervening applying roller. Note that the "certain amount of the total amount of the thus received releaser" is, for example, an amount of the releaser necessary for preventing the toner offset and the jamming in the convey path according to this arrangement in which the releaser in that certain amount is guided and applied on the intervening applying roller.

As a result, it is possible to provide a fixing apparatus in which reduction in the amount of the releaser to be applied on the roller is avoided so as to surely prevent the toner offset and the jamming in the convey path, even if toner and/or debris is adhered, as a result of long use of the image forming apparatus, on the touch position at which the releaser applying member for applying the releaser such as oil touches the roller (intervening applying roller) to which the releaser applying member applies the releaser.

Moreover, in addition to the foregoing arrangement, the fixing apparatus of the present invention may be so arranged that the guiding member is made of a material that is, per unit volume, less absorptive for the releaser than the releaser applying member is.

According to the arrangement in which the releaser is dripped onto the guiding member, increased is an amount of the releaser that is not be absorbed into the guiding member but is moved along the surface of the guiding member, compared with the arrangement in which the releaser is dripped onto the supporting member or the releaser applying member.

As a result, it is possible to have an enough amount of the releaser that moves to the touch position via the guiding member, even if, as a result of long use of the image forming apparatus, toner and/or debris is adhered on the touch position of the releaser applying member and the member to which the releaser gets applied. Thus, it is possible to avoid the reduction in the amount of the releaser to be applied on the releaser-target member.

Moreover, in addition to the foregoing arrangement, the fixing apparatus of the present invention may be so arranged that the guiding member is made of the same material as the releaser applying member and has a larger density than the releaser applying member, so as to guide, to the touch position, the releaser that moves along the surface of the guiding member.

In the foregoing arrangement, the releaser applying member is made of a material that is highly absorptive, for example. Here, the guiding member is made of the same material as the releaser applying member, but has a density larger than the releaser applying member. For example, when the releaser applying member is made of felt as the material that is highly absorptive for the releaser, it is so arranged that the guiding member is made of felt that has a density larger than that of the felt for the releaser applying member. Note that the density discussed here is not such kind of density for a material, part of which is extremely highly or lowly dense (that is, a material unevenly dense), but that kind of density for a material in which a substance is relatively evenly dense as a whole.

As a result, in addition to the effect discussed above, it is possible to evenly diffuse, inside of and on the surface of the guiding member, the releaser dripped onto the guiding member, and causes the thus diffused releaser to move to the releaser applying member, in order to apply the releaser evenly on the member to which the releaser gets applied, and which the releaser applying member touches.

Furthermore, in addition to the above arrangement, the fixing apparatus of the present invention may be so arranged that the guiding member is made of a material that is not absorptive for the releaser.

According to the foregoing arrangement, it is possible to use, for the guiding member, a material that is not absorptive for the releaser, for example, a resin made of PET (polyethylene terephthalate), or the like.

As a result, in addition to the effect discussed above, it is possible to have an enough amount of the releaser that moves to the touch position via the guiding member, even if, as a result of long use of the image forming apparatus, toner and/or debris is adhered on the touch position of the releaser applying member and the member to which the releaser gets applied. Thus, it is possible to avoid the reduction in the amount of the releaser to be applied on the member to which the releaser gets applied.

Moreover, in addition to the above arrangement, the fixing apparatus of the present invention may be so arranged that the guiding member is located so as to be associated with that side of the releaser applying member, part of which touches the fixing roller.

According to the above arrangement, it is possible to stably supply the releaser from the guiding member to the top surface side (the side on which the member to which the releaser gets applied) of the releaser applying member.

As a result, in addition to the effect discussed above, it is possible to stably supply the member to which the releaser gets applied, even if, as a result of long use of the image forming apparatus, toner and/or debris is adhered on the touch position at which the releaser applying member touches the member to which the releaser gets applied.

Moreover, in addition to the foregoing arrangement, the fixing apparatus of the present invention may be so arranged as to include a supporting member, provided under the releaser applying member, for supporting the releaser applying member, a part of the supporting member serving as the guiding member.

In the above arrangement, the part of the supporting member is used as the guiding member. For example, the present invention may be so arranged that the guiding member and the supporting member are made of the same material (that is not absorptive for the releaser) and integrated.

By arranging as such, it is possible to easily provide the guiding member in addition to the effect discussed above.

In addition to the foregoing arrangement, the fixing apparatus of the present invention may be so arranged that the guiding member is so located that movement of the releaser in the guiding member ends in an area from which movement of the releaser in the releaser applying member starts.

In the above arrangement, the guiding member is so located that movement of the releaser in the guiding member ends in an area from which movement of the releaser in the releaser applying member starts. With this arrangement, the releaser is smoothly moved from (i) the goal of the movement of the releaser in the guiding member, to (ii) the start of the movement of the releaser in the releaser applying member.

As a result, in addition to the effect discussed above, it is possible to smoothly move, to the releaser applying member, the releaser that moves inside of the guiding member and along the surface of the guiding member.

Moreover, the fixing apparatus of the present invention may be so arranged that the guiding member also serves as the releaser applying member.

In the above arrangement, for example, the guiding member and the releaser applying member are integrated. Here, the surface of the guiding member on which the releaser moves is equal to the surface of the releaser applying member. Thus, even if toner and/or debris is adhered on the surface of the releaser applying member whereby the amount of the releaser that is exuded out of the releaser applying member is reduced, it is possible to apply the releaser onto the member (such as the fixing roller or the intervening applying roller) to which the releaser gets applied, by using the releaser that moves along the surface of the guiding member (the releaser applying member).

Note that, the arrangement in which the guiding member also serves as the releaser applying member realizes a path of the releaser to move along the surface of the guiding member even if the guiding member is made of a material that is, per unit volume, less absorptive for the releaser than the conventional releaser applying member.

As a result, in addition to the foregoing effect, it is possible to stably supply the releaser to the member to which the releaser gets applied, even if, as a result of long use of the image forming apparatus, toner and/or debris is adhered on the touch position at which the releaser applying member touches the member to which the releaser gets applied.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus comprising (i) a fixing roller, (ii) a releaser applying member for applying releaser on the fixing roller by touching the fixing roller while the fixing roller is rotating, and (iii) a releaser dripping section for dripping the releaser to be applied on the fixing roller by the releaser applying member, the fixing apparatus further comprising:

a guiding member for receiving the releaser dripped from the releaser dripping section, and for guiding, along a surface thereof, a certain amount of a total amount of the thus received releaser to a touch position at which the releaser applying member touches the fixing roller, wherein releaser absorbed by the guiding member and a part of the releaser guided to the touch position are absorbed by the releaser applying member, so as to be supplied to the fixation roller.

2. The fixing apparatus as set forth In claim 1, wherein: the guiding member is made of a material that is, per unit volume, less absorptive for the releaser than the releaser applying member is.

3. The fixing apparatus as set forth in claim 1, wherein: the guiding member is made of the same material as the releaser applying member and has a larger density than the releaser applying member, so as to guide, to the touch position, the releaser that moves along the surface of the guiding member.

4. The fixing apparatus as set forth in claim 1, wherein: the guiding member is made of a material that is not absorptive for the releaser.

5. The fixing apparatus as set forth in claim 4, wherein: the guiding member is located so as to be associated with that side of the releaser applying member, part of which touches the fixing roller.

6. A fixing apparatus as set forth in claim 4, further comprising:

a supporting member, provided under the releaser applying member, for supporting the releaser applying member, a part of the supporting member serving as the guiding member.

7. The fixing apparatus as set forth in claim 1, wherein: the guiding member is so provided on a surface of the releaser applying member that the guiding member will not touch the fixing roller.

8. The fixing apparatus as set forth in claim 7, wherein; the guiding member is made of a material that is not absorptive for the releaser.

9. The fixing apparatus as set forth in claim 1, wherein: the guiding member is provided on a position higher than that of the releaser applying section so that the guiding member will not touch the fixing roller and a lower side of the guiding member touches an upper side of the releaser applying member.

10. The fixing apparatus as set forth in claim 9, wherein: the guiding member is made of the same material as the releaser applying member and has a density greater than the releaser applying member, so as to guide, to the touch position, the releaser that moves along the surface of the guiding member.

11. The fixing apparatus as set forth in claim 1, wherein: the guiding member also serves as the releaser applying member.

12. The fixing apparatus as set forth in claim 1, wherein: the guiding member is so located that movement of the releaser in the guiding member ends in an area from which movement of the releaser in the releaser applying member starts.

13. A fixing apparatus comprising: (i) a fixing roller, (ii) an intervening applying roller for applying releaser on the fixing roller while the fixing roller is rotating, (iii) a releaser applying member for applying the releaser on the intervening applying roller by touching the intervening applying roller while the intervening applying roller is rotating, and (iv) a releaser dripping section for dripping the releaser to be applied on the intervening applying roller by the releaser applying member, the fixing apparatus further comprising:

a guiding member for receiving, on an upper surface thereof, the releaser dripped from the releaser dripping section, and for guiding, along a surface thereof, a certain amount of a total amount of the thus received releaser to a touch position at which the releaser applying member touches the intervening applying roller.

14. The fixing apparatus as set forth in claim 13 wherein: the guiding member is made of a material that is, per unit volume, less absorptive for the releaser than the releaser applying member is.

15. A fixing apparatus comprising a fixing roller for fixing a toner image on a recording medium, further comprising:

a guiding member, located so as to receive releaser dripped directly onto an upper surface thereof, for guiding part of the releaser via a path to the fixing roller, and for guiding the rest of the releaser via at least one other path to the fixing roller.

* * * * *